US010612452B2

(12) United States Patent
Lee

(10) Patent No.: US 10,612,452 B2
(45) Date of Patent: Apr. 7, 2020

(54) CONTROL METHOD OF COOLANT CONTROL VALVE UNIT

(71) Applicants: HYUNDAI MOTOR COMPANY, Seoul (KR); KIA Motors Corporation, Seoul (KR)

(72) Inventor: Yonggyu Lee, Suwon-si (KR)

(73) Assignees: HYUNDAI MOTOR COMPANY, Seoul (KR); KIA Motors Corporation, Seoul (KR)

( * ) Notice: Subject to any disclaimer, the term of this patent is extended or adjusted under 35 U.S.C. 154(b) by 168 days.

(21) Appl. No.: 15/825,579

(22) Filed: Nov. 29, 2017

(65) Prior Publication Data

US 2019/0112964 A1 Apr. 18, 2019

(30) Foreign Application Priority Data

Oct. 17, 2017 (KR) ..... 10-2017-0134485

(51) Int. Cl.

| | |
|---|---|
| ***F01P 7/16*** | (2006.01) |
| ***F01P 11/02*** | (2006.01) |
| ***F01P 7/14*** | (2006.01) |

(52) U.S. Cl.

CPC ..... *F01P 7/16* (2013.01); *F01P 7/167* (2013.01); *F01P 11/0295* (2013.01); *F01P 2007/146* (2013.01); *F01P 2025/08* (2013.01); *F01P 2025/13* (2013.01)

(58) Field of Classification Search

CPC ..... F01P 7/16; F01P 11/0295; F01P 2025/08; F01P 2007/146; F01P 7/167; F01P 2025/13

See application file for complete search history.

(56) References Cited

U.S. PATENT DOCUMENTS

2003/0196612 A1* 10/2003 Le Lievre ..... F01P 7/167 123/41.1

FOREIGN PATENT DOCUMENTS

| | | |
|---|---|---|
| JP | 2015-059615 A | 3/2015 |
| KR | 10-0361305 | 11/2002 |

* cited by examiner

*Primary Examiner* — Jacob M Amick
*Assistant Examiner* — Charles Brauch
(74) *Attorney, Agent, or Firm* — McDonnell Boehnen Hulbert & Berghoff LLP

(57) ABSTRACT

A control method for a coolant control valve unit includes detecting the coolant temperature; opening a radiator coolant supply valve; controlling the opening rate of the valve if the detected coolant temperature is higher than a target coolant temperature; and calculating a first difference value by subtracting a hysteresis value from the target coolant temperature. The blocking or controlling of the opening rate is conducted according to the detected coolant temperature and the first difference value. The hysteresis value is variable according to outside temperature.

15 Claims, 5 Drawing Sheets

FIG. 3

| Outside temperature | -40 | -20 | 0 | 20 | 40 |
|---|---|---|---|---|---|
| Hysteresis value | a | b | c | d | e |

table1 (a > b > c > d > e)

FIG. 4

| Outside temperature | -40 | -20 | 0 | 20 | 40 |
|---|---|---|---|---|---|
| Predetermined time | A | B | C | D | E |

table2 (A < B < C < D < E)

CONTROL METHOD OF COOLANT CONTROL VALVE UNIT

CROSS-REFERENCE TO RELATED APPLICATION

This application claims priority to and the benefit of Korean Patent Application No. 10-2017-0134485 filed in the Korean Intellectual Property Office on Oct. 17, 2017, the entire contents of which are incorporated herein by reference.

BACKGROUND OF THE DISCLOSURE (a) Field of the Disclosure

The present disclosure relates to a control method for a coolant control valve unit that cools coolant heated by an engine by using a radiator and controls coolant flow toward the radiator to reduce heat shock applied to the radiator.

(b) Description of the Related Art

Engines produce torque by burning a fuel and discharge thermal energy. A coolant absorbs thermal energy as it circulates through an engine, a heater, and a radiator, and releases the thermal energy.

Oil becomes highly viscous at low engine coolant temperatures. With thick oil, friction and fuel consumption increase, and exhaust gas temperatures rise gradually, lengthening the time taken for catalyst activation and causing deterioration in exhaust gas quality.

When the engine coolant temperature is excessively high, knocking may occur. If ignition timing is adjusted to suppress knocking, the engine performance may be degraded. In addition, excessive lubricant temperatures may result in poor lubrication because the viscosity becomes low.

However, one coolant control valve unit is used in specific regions of an engine, and is a valve that controls a number of cooling elements, such as keeping the coolant at high temperatures and other regions at low temperatures.

As an example of a conventional art, the coolant control valve unit includes a motor, a cam rotated by the motor, a rod moved by a profile formed at one surface of the cam, and a valve formed on the rod and having a structure opening and closing a coolant passage through the valve if the cam is rotated by the motor and the profile of the cam pushes the rod.

Meanwhile, to control temperature of the coolant, the coolant control valve unit controls a valve controlling coolant supplied to the radiator, and the valve is opened when the coolant temperature in a real time exceeds a target temperature. Here, hysteresis is applied to prevent often opening and closing operations of the valve.

For example, when the target temperature is 90 degrees Celsius, the hysteresis value is applied to 2 degrees during rising of temperature and the valve is opened at 92 degrees, and the valve is closed at 88 degrees during falling of temperature.

However, when the hysteresis value is fixed regardless of the driving condition, particularly when outside temperature is low, the coolant is rapidly cooled down due to repeated opening and closing operations of the valve, although the radiator coolant supply valve is opened in a short time.

Further, as the opening and closing operations of the valve repeats, low temperature coolant is supplied to the radiator so that heat exhaustion may be deteriorated and durability may be degraded. Further, durability of other cooling components as well as the radiator may be degraded.

The above information disclosed in this Background section is only for enhancement of understanding of the background of the disclosure and therefore it may contain information that does not form the prior art that is already known in this country to a person of ordinary skill in the art.

SUMMARY OF THE DISCLOSURE

The present disclosure has been made in an effort to provide a control method of a coolant control valve unit to improve durability of a radiator by reducing heat shock applied to the radiator, and improve durability of a valve by reducing often opening and closing operations of the valve when the outside temperature is low.

A control method of a coolant control valve unit according to an exemplary embodiment of the present disclosure includes detecting a coolant temperature; opening a radiator coolant supply valve and controlling an opening rate of the valve if the detected coolant temperature is higher than a target coolant temperature; and calculating a first difference value by subtracting a hysteresis value from the target coolant temperature, wherein controlling of the opening rate is conducted according to the detected coolant temperature and the first difference value, the controlling of the opening rate includes blocking the valve, and the hysteresis value is variable according to an outside temperature.

The control method may further include blocking the valve if it is determined that the detected coolant temperature is lower than the target coolant temperature.

The hysteresis value increases as the outside temperature decreases.

The valve may be opened and the opening rate may be controlled if the detected coolant temperature is higher than the first difference value.

It is determined whether an opening duration time of the valve is longer than a predetermined time if the detected coolant temperature is lower than the first difference value, and the valve may be blocked if the opening duration time of the valve is longer than the predetermined time.

It is determined whether the detected coolant temperature is higher than a predetermined temperature if the opening duration time of the valve is smaller than the predetermined time, and the valve may be opened and the opening rate may be controlled if the detected coolant temperature is higher than the predetermined temperature.

The valve may be blocked if the detected coolant temperature is lower than the predetermined temperature.

The opening rate of the valve may be predetermined by a drive condition.

The drive condition may be predetermined by an engine RPM, an engine torque, the detected coolant temperature, or the target coolant temperature.

The predetermined time may be variable according to an outside temperature.

The predetermined time decreases as the outside temperature decreases.

A control method of a coolant control valve unit according to an exemplary embodiment of the present disclosure includes blocking a radiator coolant supply valve if it is determined that a detected coolant temperature is lower than a target coolant temperature; opening the valve and controlling an opening rate of the valve if the detected coolant temperature is higher than the target coolant temperature; calculating a first difference value by subtracting a hysteresis value from the target coolant temperature; determining whether an opening duration time of the valve is longer than a predetermined time if the detected coolant temperature is lower than the first difference value; and blocking the valve if the opening duration time of the valve is longer than the predetermined time, and the predetermined time is variable according to an outside temperature.

The predetermined time decreases as the outside temperature decreases, and the opening rate may be controlled when the valve is opened if the opening duration time is shorter than the predetermined time.

According to an exemplary embodiment of the present disclosure, heat shock applied to the radiator is reduced to improve durability of the radiator when the outside temperature is low.

Further, durability of a radiator coolant supply valve is improved by reducing often opening and closing operations of the valve.

Further, without changing structure of the radiator, durability of cooling components other than the radiator may be improved through the control method of the coolant control valve unit.

BRIEF DESCRIPTION OF THE DRAWINGS

FIG. 3 is a table illustrating hysteresis values in a control method of a coolant control valve unit according to an exemplary embodiment of the present disclosure.

FIG. 4 is a table illustrating predetermined times in a control method of a coolant control valve unit according to an exemplary embodiment of the present disclosure.

DETAILED DESCRIPTION OF THE EMBODIMENTS

Figure 1:
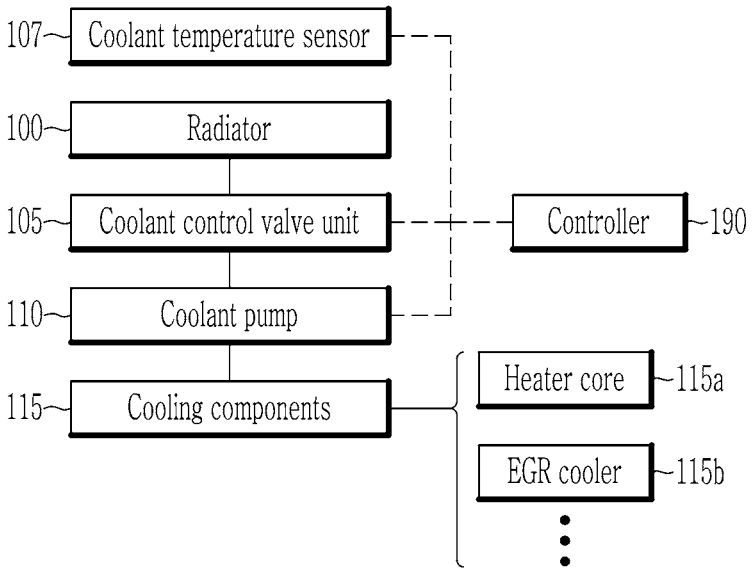
FIG. 1 is a schematic diagram of a cooling system including a coolant control valve unit according to an exemplary embodiment of the present disclosure.

An exemplary embodiment of the present disclosure will hereinafter be described in detail with reference to the accompanying drawings.

However, the size and thickness of each configuration illustrated in the drawings are arbitrarily illustrated for explanatory convenience, but the present disclosure is not limited thereto, and the thicknesses are enlarged for expressing various portions and regions.

In addition, in order to explain an exemplary embodiment of the present disclosure, a portion, which is not related to the description, is omitted, and like reference numerals designate like or similar constituent elements throughout the specification.

Names of elements in the following description are distinguished into first, second, and the like in order to distinguish the elements because the names of the elements are the same and are not particularly limited to an order thereof.

FIG. 1 is a schematic diagram of a cooling system including a coolant control valve unit according to an exemplary embodiment of the present disclosure.

Referring to FIG. 1, a cooling system includes a coolant temperature sensor 107, a radiator 100, a coolant control valve unit 105, a coolant pump 110, cooling components 115, and a controller 190. The cooling components 115 include a heater core 115*a* and an EGR cooler 115*b*, etc.

In one exemplary embodiment, the coolant pump 110 pumps coolant to a cylinder block (not illustrated) and a cylinder head (not illustrated) of the engine, and the coolant control valve unit 105 is supplied with coolant exhausted from the cylinder head and the cylinder block.

The coolant control valve unit 105 may control the coolant distributed to the cooling components 115 including the heater core 115*a* and the EGR cooler, etc.

The coolant temperature sensor 107 may detect the temperature of the coolant passing through an outlet of the coolant pump 110, an inlet of the coolant control valve unit 105, the cylinder head, or the cylinder block. The detected temperature signal is transferred to the controller 190.

The controller 190 may control operation of the coolant control valve unit 105 and the coolant pump 110 according to a drive condition. The drive condition may include an engine RPM, a torque (fuel injection amount), outside temperature, detected coolant temperature, target coolant temperature, or vehicle speed, etc.

In an exemplary embodiment of the present disclosure, the controller 190 may be realized as at least one microprocessor operating by a predetermined program. The predetermined program may include a series of orders for conducting the method according to an exemplary embodiment of the present disclosure.

Figure 2:
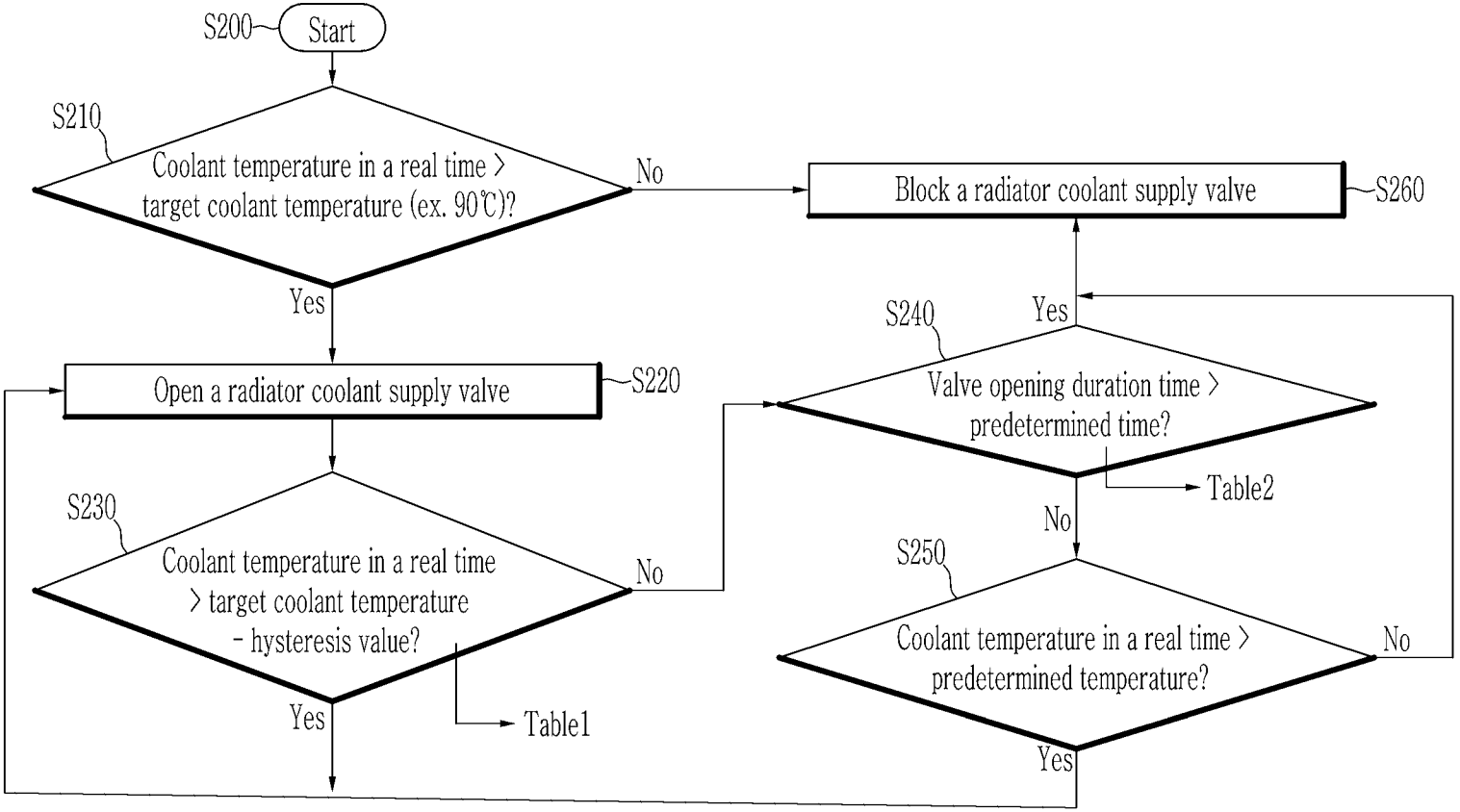
FIG. 2 is a flowchart illustrating a control method of a coolant control valve unit according to an exemplary embodiment of the present disclosure.

FIG. 2 is a flowchart illustrating a control method of a coolant control valve unit according to an exemplary embodiment of the present disclosure.

Referring to FIG. 2, control is conducted at S200, and the controller 190 determines whether a detected coolant temperature is higher than a target coolant temperature at S210.

Here, if it is determined that the detected coolant temperature is lower than the target coolant temperature, S260 is conducted. If it is determined that the detected coolant temperature is greater than the target coolant temperature, S220 is conducted.

In S260, the controller 190 controls the coolant control valve unit 105 to block a coolant supply valve supplying coolant to the radiator 100.

In S220, the controller 190 opens the coolant supply valve supplying the coolant to the radiator 100 and controls the opening rate of this valve according to a drive condition. Then, S230 is conducted.

In S230, the controller 190 determines whether the detected coolant temperature is higher than a first difference value. Here, the first difference value is a hysteresis value subtracted from the target coolant temperature. If the detected coolant temperature is higher than the first difference value, then S220 is conducted again. If the detected coolant temperature is lower than the first difference value, then S240 is conducted.

In S240, the controller 190 determines the opening duration time of the valve supplying the coolant to the radiator 100, and determines whether the opening duration time is longer than a predetermined time.

If the opening duration time is longer than the predetermined time, S260 is conducted and the valve is blocked. If the opening duration time is shorter than the predetermined time, then S250 is conducted.

In S250, the controller 190 determines whether the detected coolant temperature is higher than a predetermined temperature. Here, the predetermined temperature may be a warm-up coolant temperature. If the detected coolant temperature is higher than the predetermined temperature, then S220 is conducted. If the detected coolant temperature is lower than the predetermined temperature, then S260 is conducted.

In an exemplary embodiment of the present disclosure, the detected coolant temperature is a coolant temperature detected by the coolant temperature sensor 107, and the target coolant temperature is a predetermined value according to a drive condition and may be predetermined as 90 degrees Celsius.

The hysteresis value has a 2 degree reference value and may be chosen according to the outside temperature. The predetermined time has a 5 second reference value and may be variably chosen according to the outside temperature. Further, the predetermined temperature may be predetermined as 80 degrees Celsius.

FIG. 3 is a table illustrating hysteresis values in a control method of a coolant control valve unit according to an exemplary embodiment of the present disclosure.

Referring to FIG. 3, it shows hysteresis values varying according to outside temperature. If the outside temperature is −40 degrees Celsius, then the hysteresis value is a. If the outside temperature is −20 degrees Celsius, then the hysteresis value is b. Further, if the outside temperature is 0 degrees Celsius, then the hysteresis value is c. If the outside temperature is 20 degrees Celsius, then the hysteresis value is d. If the outside temperature is 40 degrees Celsius, then the hysteresis value is e. The hysteresis value may vary linearly according to the outside temperature, and have magnitude relation of a>b>c>d>e.

FIG. 4 is a table illustrating predetermined times in a control method of a coolant control valve unit according to an exemplary embodiment of the present disclosure.

Referring to FIG. 4, it shows predetermined times varying according to outside temperature. If the outside temperature is −40 degrees Celsius, then the predetermined time is A. If the outside temperature is −20 degrees Celsius, then the predetermined time is B. Further, if the outside temperature is 0 degrees Celsius, then the predetermined time is C. If the outside temperature is 20 degrees Celsius, then the predetermined time is D. If the outside temperature is 40 degrees Celsius, then the predetermined time is E. The predetermined time may vary linearly according to the outside temperature, and have magnitude relation of A>B>C>D>E.

According to an exemplary embodiment of the present disclosure, the durability of the radiator 100 may be improved by reducing heat shock applied to the radiator 100 by reducing number of opening and closing operations of the valve when the outside temperature is low.

Further, the durability of the valve may be improved by reducing often opening and closing operations of the valve. Without changing the structure of the radiator 100, the durability of cooling components 115 other than the radiator 100 may be improved through the control method of the coolant control valve unit.

Figure 5:
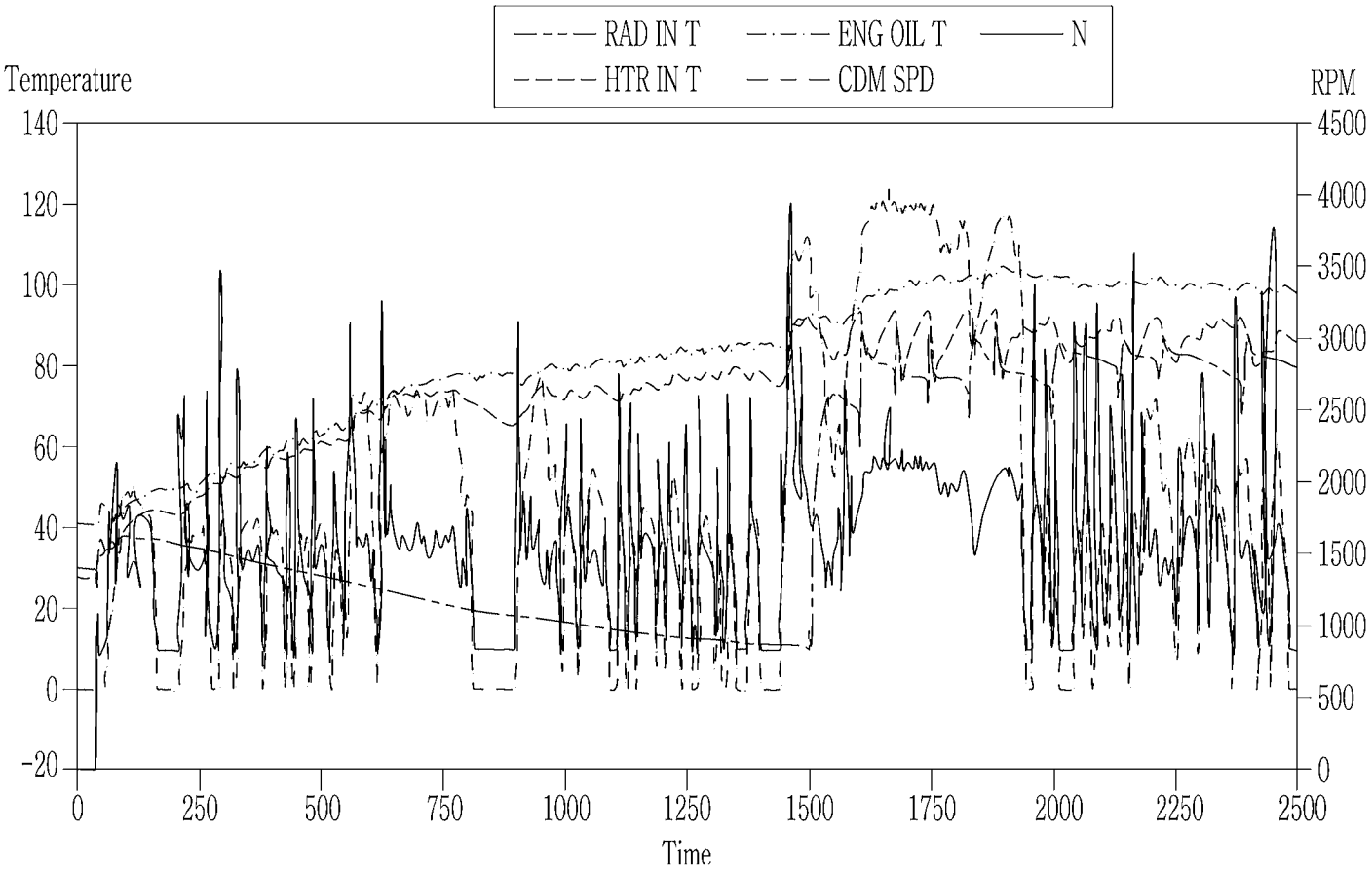
FIG. 5 is a table illustrating drive conditions and coolant temperature according to an exemplary embodiment of the present disclosure.

FIG. 5 is a table illustrating drive conditions and coolant temperature according to an exemplary embodiment of the present disclosure.

Referring to FIG. 5, a horizontal axis represents time, and a vertical axis represents temperature and RPM.

RAD IN T represents coolant temperature flowing into the radiator 100. HTR IN represents coolant temperature flowing into the heater core 115*a*. ENGINE OIL T represents temperature of oil circulating the engine. CDM SPD represents a vehicle speed and N represents rotation speed (RPM) of the engine.

As illustrated, as a reference of time, after 1500, the coolant temperature flowing into the radiator 100 varies about 80 degrees. The variation period is not excessively short, varies on a reference of 80 degrees, and stably maintains above 60 degrees.

In an exemplary embodiment of the present disclosure, the hysteresis value of the valve supplying the coolant to the radiator 100 is varied according to the outside temperature. Therefore, heat shock applied to the radiator 100 may be reduced.

Further, the minimum opening duration time of the valve is predetermined to prevent the valve supplying the coolant to the radiator 100 from often opening and closing. Therefore, the noise of the outside air may be reduced and robustness may be improved.

Further, the opening duration time of the valve is predetermined gradually according to the outside temperature. Therefore, the valve operates identically with a conventional valve in a condition in which the outside temperature is not a low temperature (a condition in which there is not radiator heat shock) to improve salability.

Further, a warm-up coolant temperature is predetermined to prevent over cooling since the engine may be over cooled due to the opening duration time. Therefore, an increase of harmful exhaust gas of the engine, an increase of fuel consumption, and a deterioration of heating performance may be prevented.

While this disclosure has been described in connection with what is presently considered to be practical exemplary embodiments, it is to be understood that the disclosure is not limited to the disclosed embodiments.

What is claimed is:

1. A control method of a coolant control valve unit, comprising:

detecting a coolant temperature;

opening a radiator coolant supply valve and controlling an opening rate of the valve if the detected coolant temperature is higher than a target coolant temperature; and calculating a first difference value by subtracting a hysteresis reference value from the target coolant temperature, wherein controlling of the opening rate is conducted according to the detected coolant temperature and the first difference value, the controlling of the opening rate includes blocking the valve, and the hysteresis reference value is variable according to an outside temperature.

2. The control method of claim 1, wherein:

blocking the valve if it is determined that the detected coolant temperature is lower than the target coolant temperature.

3. wherein the hysteresis reference value increases as the outside temperature decreases.

4. The control method of claim 2, wherein:

the valve is opened and the opening rate is controlled if the detected coolant temperature is higher than the first difference value.

5. The control method of claim 2, further comprising:

determining whether an opening duration time of the valve is longer than a predetermined time if the detected coolant temperature is lower than the first difference value; and blocking the valve if the opening duration time of the valve is longer than the predetermined time.

6. The control method of claim 5, wherein:

determining whether the detected coolant temperature is higher than a predetermined temperature if the opening duration time of the valve is smaller than the predetermined time.

7. The control method of claim 6, wherein:

the valve is opened and the opening rate is controlled if the detected coolant temperature is higher than the predetermined temperature.

8. The control method of claim 6, wherein:

the valve is blocked if the detected coolant temperature is lower than the predetermined temperature.

9. The control method of claim 1, wherein:

the opening rate of the valve is predetermined by a drive condition.

10. The control method of claim 9, wherein:

the drive condition is predetermined by an engine RPM, an engine torque, the detected coolant temperature, or the target coolant temperature.

11. The control method of claim 5, wherein:

the predetermined time is variable according to an outside temperature.

12. The control method of claim 11, wherein:

the predetermined time decreases as the outside temperature decreases.

13. A control method of a coolant control valve unit, comprising:

blocking a radiator coolant supply valve if it is determined that a detected coolant temperature is lower than a target coolant temperature;

opening the valve and controlling an opening rate of the valve if the detected coolant temperature is higher than the target coolant temperature;

calculating a first difference value by subtracting a hysteresis reference value from the target coolant temperature;

determining whether an opening duration time of the valve is longer than a predetermined time if the detected coolant temperature is lower than the first difference value; and blocking the valve if the opening duration time of the valve is longer than the predetermined time, and the predetermined time is variable according to an outside temperature.

14. The control method of claim 13, wherein:

the predetermined time decreases as the outside temperature decreases.

15. The control method of claim 13, wherein:

the opening rate is controlled when the valve is opened if the opening duration time is shorter than the predetermined time.

* * * * *